US010941537B2

(12) United States Patent
Eagle et al.

(10) Patent No.: US 10,941,537 B2
(45) Date of Patent: Mar. 9, 2021

(54) PREFABRICATED FORMER FOR CONSTRUCTING UNDERGROUND CHAMBER

(71) Applicant: Dutypoint Limited, Gloucester (GB)

(72) Inventors: Timothy Olof Eagle, Wallingford (GB); Robert James Freeman, Gloucester (GB)

(73) Assignee: Dutypoint Limited, Gloucester (GB)

( * ) Notice: Subject to any disclaimer, the term of this patent is extended or adjusted under 35 U.S.C. 154(b) by 0 days.

(21) Appl. No.: 16/537,977

(22) Filed: Aug. 12, 2019

(65) Prior Publication Data

US 2020/0048857 A1 Feb. 13, 2020

(30) Foreign Application Priority Data

Aug. 13, 2018 (GB) ..... 1813191

(51) Int. Cl.

| | |
|---|---|
| ***E02D 29/12*** | (2006.01) |
| ***B65D 88/76*** | (2006.01) |
| ***E02D 29/05*** | (2006.01) |
| ***E03B 5/04*** | (2006.01) |
| ***E21D 11/10*** | (2006.01) |

(52) U.S. Cl.

CPC ..... *E02D 29/124* (2013.01); *B65D 88/76* (2013.01); *E02D 29/05* (2013.01); *E03B 5/04* (2013.01); *E21D 11/10* (2013.01)

(58) Field of Classification Search

CPC ..... E02D 29/055; E02D 29/124; E02D 29/12; E02D 29/05; B65D 90/105; B65D 90/501; B65D 88/76; B65D 7/22; E03B 5/04; E03B 3/16; E03B 3/10; E03B 11/14; E03B 5/00;

(Continued)

(56) References Cited

U.S. PATENT DOCUMENTS 2,136,390 A * 11/1938 Mchugh ..... E04H 7/18 52/265
2,595,923 A * 5/1952 Carlson ..... E03B 3/10 210/542

(Continued)

FOREIGN PATENT DOCUMENTS

GB 2258872 A 8/1991
WO 2008141620 A2 11/2008

OTHER PUBLICATIONS

Intellectual Property Office, Search Report for application No. BG1813191.2, dated Jan. 17, 2019, 2 pages, www.gov.uk.ipo.

*Primary Examiner* — Brent W Herring
(74) *Attorney, Agent, or Firm* — Marshall & Melhorn, LLC

(57) ABSTRACT

A prefabricated former for an underground pump station comprises: a floor former; a plurality of vertical support elements; a side wall secured to and surrounding the plurality of vertical support elements, the side wall having an inner layer and an outer layer defining a cavity therebetween, and an opening at an upper end of the side wall in communication with the cavity for receiving concrete, the side wall extending both above and below the floor former for defining a space above the floor former and a space below the floor former, and an opening being provided between the cavity and the space below the floor former enabling concrete to flow through the cavity and into the space below the floor former; when set, the concrete forming a unitary wall and base.

19 Claims, 4 Drawing Sheets

(58) Field of Classification Search
CPC .... E03F 5/024; E03F 5/10; E03F 5/02; E21D 11/10
USPC ... 52/2.15, 19–21, 169.6, 169.7, 169.8, 250, 52/259, 414, 742.14
See application file for complete search history.

(56) References Cited

U.S. PATENT DOCUMENTS 3,399,505 A * 9/1968 Comment ..... E04G 11/02 52/742.14
3,438,157 A * 4/1969 La Monica ..... E02D 29/12 52/20
3,596,419 A * 8/1971 Jalbert ..... E04H 13/00 52/137
3,990,672 A * 11/1976 Buchanan ..... E04G 13/02 249/48
4,005,253 A * 1/1977 Walter ..... H01F 27/06 174/37
4,183,221 A * 1/1980 Yamamoto ..... F17C 3/04 62/53.1
4,341,236 A * 7/1982 LaBenz ..... E03F 5/02 137/363
4,444,221 A * 4/1984 LaBenz ..... E03F 5/02 137/363
4,523,454 A * 6/1985 Sharp ..... B65D 90/501 220/560.03
4,607,522 A * 8/1986 Sharp ..... B65D 90/501 73/49.2
4,805,360 A * 2/1989 Kuehnl ..... E04H 9/12 52/169.1
5,495,695 A * 3/1996 Elliott, Jr. ..... B65D 88/76 220/565
5,791,098 A * 8/1998 Thomas ..... E02D 29/12 220/4.28
6,006,944 A * 12/1999 Machledt ..... B65D 88/76 220/567.1
6,196,761 B1 * 3/2001 Stanton ..... B60S 5/02 137/312
6,395,213 B1 * 5/2002 Staskiewicz ..... B28B 7/0008 249/100
6,438,906 B1 * 8/2002 Komarowski ..... E04H 9/14 52/169.1
6,606,836 B2 * 8/2003 Miller ..... B28B 7/0008 405/129.55
7,918,056 B2 * 4/2011 Yamaguchi ..... E02D 29/045 52/169.14
8,708,183 B2 * 4/2014 Burke ..... B65D 90/00 220/328
8,783,501 B2 * 7/2014 Mookerjee ..... F17C 3/022 137/264
10,788,271 B2 * 9/2020 De Groot ..... E02D 27/38
2003/0167708 A1 * 9/2003 Shaw ..... E04H 9/08 52/169.6
2004/0159060 A1 * 8/2004 Giri ..... E02D 29/12 52/415
2009/0064604 A1 * 3/2009 Yamaguchi ..... E02D 29/045 52/169.6
2009/0095878 A1 * 4/2009 Way ..... E04B 2/86 249/132
2010/0251649 A1 * 10/2010 Woolbright ..... E04C 1/395 52/309.17
2011/0197975 A1 * 8/2011 Stiatti ..... E03B 11/14 137/371
2011/0203192 A1 * 8/2011 Schneider ..... E02D 29/124 52/20
2012/0285105 A1 * 11/2012 Burke ..... B65D 90/00 52/124.2
2013/0025223 A1 * 1/2013 Woolbright ..... E02D 29/025 52/309.1
2013/0248680 A1 * 9/2013 Fergeson ..... B28B 7/0014 249/11
2014/0311048 A1 * 10/2014 Hill ..... E03F 5/02 52/19
2016/0138298 A1 * 5/2016 Wallulis ..... E02D 27/32 256/65.14
2016/0305108 A1 * 10/2016 Eftekharzadeh ..... E03B 3/03
2018/0087845 A1 * 3/2018 De Groot ..... E04H 7/18

* cited by examiner

PREFABRICATED FORMER FOR CONSTRUCTING UNDERGROUND CHAMBER

The present invention relates to a prefabricated former for an underground pumping station.

BACKGROUND TO THE INVENTION

In some areas, ground or sewage water may need to be pumped upwards to main drains for removal. It is necessary to install pumps for this purpose underground and pumps are typically installed in subterranean chambers, where they can be accessed for servicing.

Subterranean chambers for water pumps must be strong to resist the weight of structures above the chamber, and also hydrostatic pressure on the walls and base of the chamber in locations where the chamber extends below the water table. Such chambers are therefore often constructed with reinforced concrete walls and a separately poured concrete base. This construction process requires excavation of a hole, and assembly of shuttering within the hole for receiving the concrete. This requires operatives to work in the excavation for extended periods to assemble the shuttering, posing health and safety risks. Shuttering assembly also increases the time required for construction.

One solution is to provide a polyethylene or GRP tank which is placed on a concrete base and surrounded by concrete. Effectively, the tank provides a waterproof liner for the chamber. Waterproofing of the chamber is important to protect the pumping equipment in the chamber against water damage. However, with this solution, a significant amount of groundwork is still required in forming the base and it is necessary to shutter around the tank before pouring the concrete around it.

A further issue with installation of subterranean pump chambers below the water table is that the hydrostatic forces from water surrounding the chamber exert a significant upwards force, or buoyancy. This may cause even a strong walled chamber to gradually rise upwards from the ground, posing a hazard and potentially damaging other structures. It is therefore very important that the structural engineers on site ensure that there is sufficient weight of concrete in the structure to counter this buoyancy and prevent the chamber from rising up. In many cases, this is not properly considered and the chambers effectively float upwards, damaging pipework, electrical supplies and above ground works. Also, if the depth of the pump is no longer fit for purpose because it is too high in the ground, the chamber has to be dug up and a new chamber installed.

It is an object of the present invention to provide a prefabricated former suitable for building a subterranean chamber for a water pump which mitigates or substantially reduces the abovementioned problems.

STATEMENT OF INVENTION

According to a first aspect of the present invention, there is provided a prefabricated former for an underground pumping station comprising:

a floor former; a plurality of vertical support elements; a side wall secured to and surrounding the plurality of vertical support elements, the side wall having an inner layer and an outer layer defining a cavity therebetween, and an opening at an upper end of the side wall in communication with the cavity for receiving concrete, the side wall extending both above and below the floor former for defining a space above the floor former and a space below the floor former, and an opening being provided between the cavity and the space below the floor former enabling concrete to flow through the cavity and into the space below the floor former; when set, the concrete forming a unitary wall and base.

When installed and filled with concrete, the side wall and space under the floor former provide a strong concrete chamber for housing a water pump. The side wall and floor former define spaces in which concrete may flow to provide this chamber. The space below the floor former, when filled with concrete, provides a strong and heavy base. This provides a ballast weight to resist buoyancy of the chamber caused by hydrostatic pressure, advantageously preventing the chamber from rising out of the ground.

The space above the floor former provides the interior of the chamber, which is a clear volume for receiving a water pump and/or other apparatus. The support elements provide structural support, both to the prefabricated former during transit and installation, and to the finished chamber. In particular, the support elements resist compression forces of the wet concrete.

The prefabricated former provides a rapid means of constructing a subterranean chamber for a pump, because the inner and outer layers of the side wall, in combination with the floor former, obviate the need for a pre-installed concrete base and traditional shuttering, reducing installation time and reducing the requirement for operatives to work within an excavation.

A further advantage of the invention is that the relative size of the area above the floor former to the area below the floor former which is enclosed by the side wall may be easily varied, either by lengthening or shortening the side wall, or by altering the position of the floor former along the vertical support elements. This means that, in areas where the water table is higher, a larger base may be provided to counteract the increased buoyancy. The internal position of the base is set in a factory on construction of the former and so it can be accurately set so that the weight of concrete under the floor is sufficient to counteract any buoyancy problems encountered on site.

The plurality of vertical support elements may be secured around a periphery of the floor former. This provides structural support around the circumference of the side wall and leaves a clear interior area above the floor former for receiving pumping apparatus.

The inner layer may extend beyond the floor, but less far than the outer layer towards a bottom end of the side wall. This allows concrete to flow from the cavity of the side wall into the space below the floor former to provide a solid base.

The side wall may have the form of a prism. This allows the height of the prefabricated former, and hence the height of the chamber, to be varied easily. This also allows prefabricated formers of a variety of sizes to be provided by varying the length of the prism, while still being transportable by lorry. The side wall can also be constructed from substantially flat panels welded together at seams.

The side wall may have the form of an octagonal prism.

The side wall may be made of a plastics material.

The side wall may include polyvinyl chloride.

The floor former may be fluid-tight. This prevents concrete from being forced up through the floor former into the space above the floor former during pouring, so that the space above the floor former remains free for receiving pumping apparatus.

The portion of the side wall above the floor former may be fluid-tight. This prevents concrete from being forced into the space above the floor former during pouring.

The floor former may be substantially concave. This provides a strong join between the base of the chamber and the side wall of the chamber, while maximising space inside the chamber for pumping apparatus.

The floor former may include a central planar portion and an outer angled portion which is angled with respect to the central planar portion.

The floor former may be GRP or steel, for example, galvanised steel.

The prefabricated former may further comprise a roof attached to an upper end of the plurality of support elements.

The roof, the portion of the side wall above the floor former and the floor former may collectively define a fluid-tight chamber.

The roof may include an access opening. This allows operatives to access the chamber from above for repair or maintenance of the pumping apparatus.

The inner layer of the side wall may abut an edge of the roof and the outer layer of the side wall may extend past and above the roof. In combination with the roof, this provides a tray structure at the upper end of the prefabricated former for receiving concrete to form a concrete roof of the chamber.

The access opening may be surrounded by a vertical rim joined to the roof. This prevents concrete from covering the access opening. The access opening may be closable by a hatch.

The side wall may include an opening for receiving a utility conduit. This allows the pumping apparatus inside the chamber to be connected to utility conduits such as water pipes.

The prefabricated former may further comprise a mid-plate attached at its periphery to the plurality of vertical support elements and spaced from the floor former. The mid plate provides further structural support to the former and also provides a conveniently positioned internal floor, which makes entry to the completed chamber safer.

The prefabricated former may further comprise a water pumping apparatus.

According to a second aspect of the invention, there is provided a method of constructing a subterranean pumping chamber, comprising excavating a hole in the ground or utilising an existing hole; placing a prefabricated former according to the first aspect of the invention in the hole below ground level; introducing concrete into the cavity of the side wall so that the concrete flows down the cavity and into the space below the floor former.

The method provides for rapid construction of a subterranean pumping chamber, and minimises the amount of time spent by operatives in an excavation. The side wall of the former replaces traditional shuttering, meaning that no shuttering needs to be assembled on side. The space below the floor former provides a base for the chamber once concrete has been introduced and set. This strengthens the chamber and weights it against buoyancy.

The method may further comprise the step of mechanically agitating the concrete before the concrete has set. This further liquefies the concrete, reducing the chance of air-bubble formation which would weaken the resulting structure, and increasing the speed of the pour.

The method may further comprise the step of introducing material around the prefabricated former to bury the prefabricated former.

The concrete may extend over the roof of the prefabricated former.

In a further aspect of the invention, there is provided a prefabricated former for an underground pumping station comprising: a floor former; a plurality of vertical support elements; a side wall secured to and surrounding the plurality of vertical support elements, the side wall having an inner layer and an outer layer defining a cavity therebetween, and an opening at an upper end of the side wall in communication with the cavity for receiving concrete, the side wall extending both above and below the floor former for defining a space above the floor former and a space below the floor former, and an opening being provided between the cavity and the space below the floor former enabling concrete to flow through the cavity and into the space below the floor former; when set, the concrete forming a unitary wall and base.

This aspect of the invention may include any of the preceding features, or combinations of features, presented with respect to the preceding aspects of the invention.

BRIEF DESCRIPTION OF THE DRAWINGS

For a better understanding of the present invention, and to show more clearly how it may be carried into effect, reference will now be made by way of example only to the accompanying drawings, in which.

DESCRIPTION OF PREFERRED EMBODIMENTS

Figure 1:
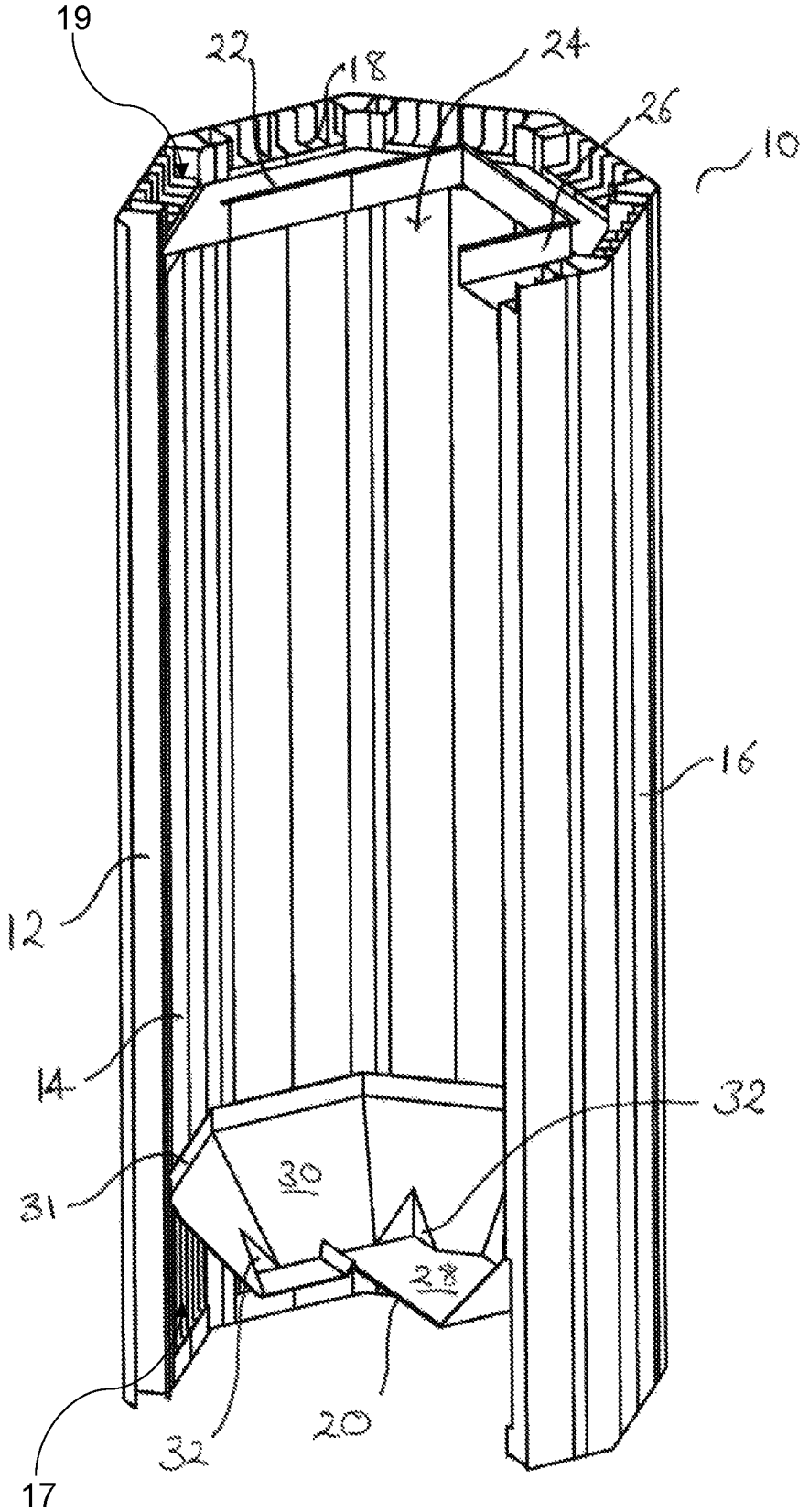
FIG. 1 shows a partially cross-sectional perspective view of a prefabricated former for an underground pump station.
Figure 2:
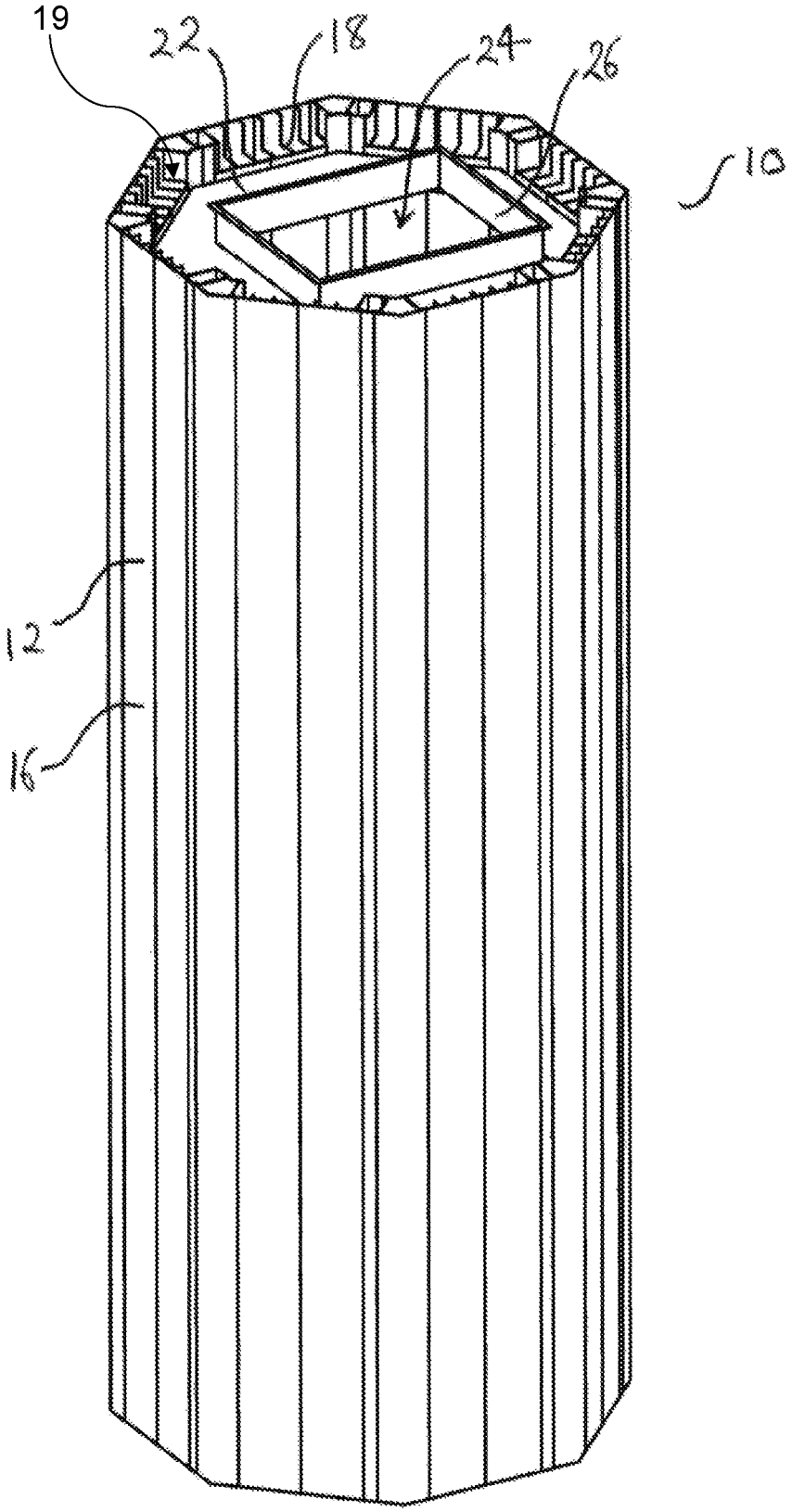
FIG. 2 shows a perspective view of the prefabricated former of FIG. 1.

Referring firstly to FIGS. 1 and 2, a prefabricated former for an underground pump station is indicated generally at 10.

The former includes a side wall 12. The side wall 12 has an inner layer 14 and an outer layer 16 defining a cavity therebetween. Each of the inner layer 14 and outer layer 16 has the form of an octagonal prism, i.e. forming a circumferential and continuous wall, for example, with an octagonal cross section when viewed from above. The inner layer 14 and the outer layer 16 are concentric. The inner layer 14 has a smaller cross-section than the outer layer 16. The side wall is made from plastics and is waterproof.

The inner layer 14 has a shorter length, or areas of shorter length than the outer layer 16. The continuous inner layer 14 has a lower end, which is situated above an upper end of the outer layer 16. The inner layer 14 has an upper end which is situated substantially below the upper end of the outer layer 16. Alternative inner layer designs are possible, as long as a continuous inner layer is provided around one area for forming a chamber, and there are spaces or gaps 17 in the inner layer close to the bottom forming openings for allowing concrete to flow out of the cavity.

Between the inner layer 14 and outer layer 16, a plurality of webs 18 is provided. Each web is a planar elongate element, having a first long edge and a second long edge. The first long edge of each web 18 is joined to the outer layer 16 and the second long edge of each web is joined to the inner layer 14. Each web therefore bridges the cavity between the inner and outer layers 14, 16. Each web includes a plurality of apertures (not shown) for allowing concrete to flow past the webs during pouring.

At the upper end of the side wall 12, the cavity is open for providing an entry point or opening 19 for concrete to be poured between the layers of the wall.

The prefabricated former also includes a floor former 20. The floor former 20 is a concave element. The floor former 20 is defined by an edge which follows the profile of the inner layer 14 of the side wall 12. The floor former 20 is disposed within the side wall 12. The floor former 20 divides the volume within the inner layer 14 of the side wall 12 into a volume above the floor former 12 and a volume below the floor former 12.

The floor former 20 includes a central planar portion 28 and an outer angled portion 30 which is angled up and away, for example, at around 120 degrees towards the side wall from the periphery of the central planar portion 28. A circumferential flange 31 extends around the upper edge of the angled portion 30. The circumferential flange 31 is disposed vertically, as viewed and in use. The circumferential flange 31 lies against and is sealed to the inner layer 14 of the side wall 12. The central planar portion 28 lies horizontally in use.

The outer angled portion 30 includes a plurality of recesses 32. The recesses 32 are formed by the meeting of corners of the central planar portion 28 with substantially vertical joining surfaces, the joining surfaces connecting the corners of the central planar portion 28 to the outer angled portion. The recesses 32 allow the central planar portion to have a larger footprint for accommodating rectangular based objects, such as pumping apparatus.

The floor former 20 is fluid-tight. The floor former 20 is sealed to the inner layer 14 of the side wall 12. There is therefore no internal fluid flow path from the area above the floor former 20 to the area below the floor former 20.

The floor former 20 is preferably made of glass reinforced plastic, but may be made from steel, preferably galvanised steel.

The prefabricated former 10 also includes a roof 22. The roof 22 is a planar member defined by an edge having a profile matching the interior layer 14 of the side wall 12. The roof 22 is made of steel.

The roof 22 is joined to the inner layer 14 of the side wall 12. This join is fluid-tight. Specifically, the roof 22 is joined to the upper edge of the inner layer 14. The outer layer 16 projects above the roof 22 and upper edge of the inner layer 14.

An access opening 24 is provided in the roof 22. The access opening 24 is closable by a hatch (not shown).

A rim 26 is provided around the access opening 24. The rim 26 is a wall protruding from an upper surface of the roof 26. The rim 26 describes a closed path around the opening 24. In this embodiment, the rim 26 is joined to the edge of the opening 24.

Figure 3:
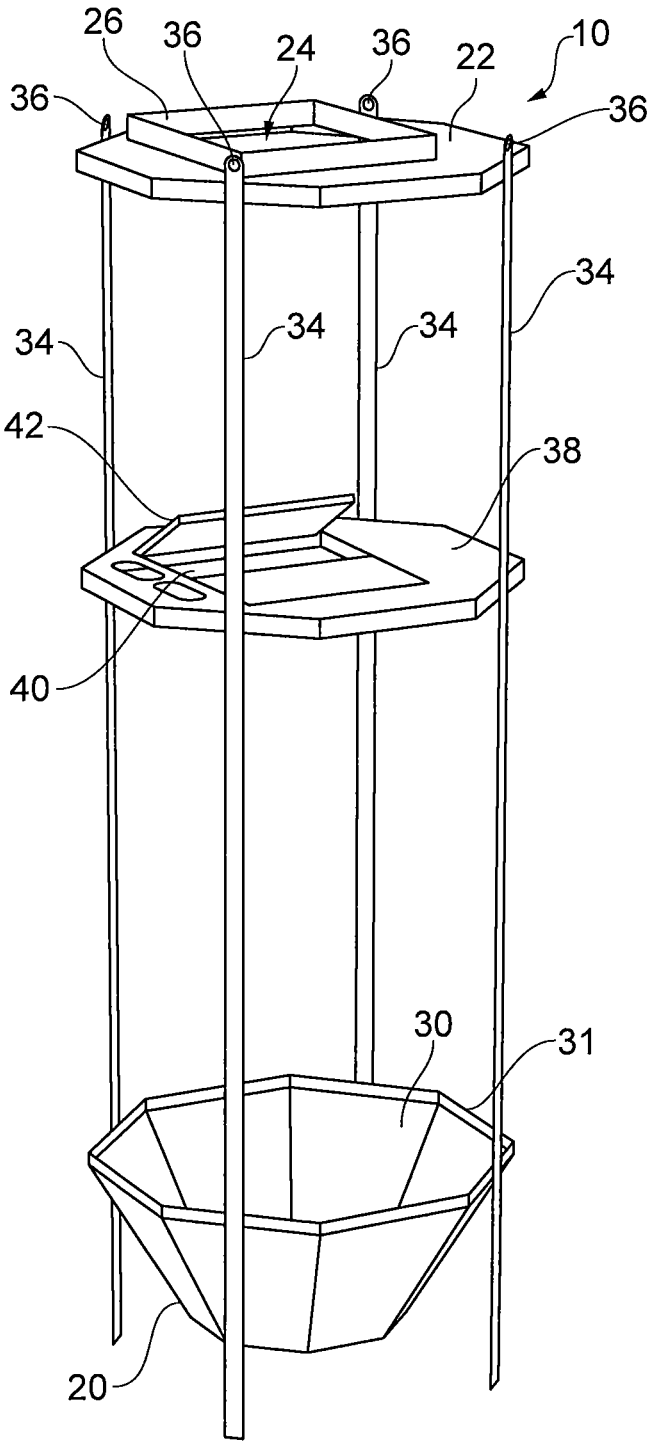
FIG. 3 shows a perspective view of the prefabricated former of FIG. 1 without a side wall.

Referring now to FIG. 3, the prefabricated former 10 is shown without the side wall 12.

The prefabricated former 10 includes a plurality of vertical support elements 34. Each vertical support element 34 is a length of steel bar. In this embodiment, there are four vertical support elements 34.

Each vertical support element 34 is joined to the floor former 20 at a periphery of the floor former 20. Each vertical support element 34 is also joined to the roof 22 at a periphery of the roof 22.

An upper end of each vertical support element 34 extends beyond an upper surface of the roof 22. The upper end of each vertical support element 43 includes an aperture 36 for receiving fittings for transportation, such as for connection to a crane.

A lower end of each support element 34 extends below the central planar portion 28 of the floor former 20. When the former 10 is placed on a flat surface, it is supported via the support elements 34 and a clearance exists between the central planar portion 28 of the floor former 20 and the flat surface.

The former 10 also includes a mid plate 38. The mid plate 38 is joined to each of the support elements 34 at its periphery. The mid plate 38 is situated substantially midway between the roof 22 and the floor former 20. The mid plate 38 is a planar member defined by an edge which conforms to the inner profile of the inner layer 14 of the side wall 12.

Figure 4:
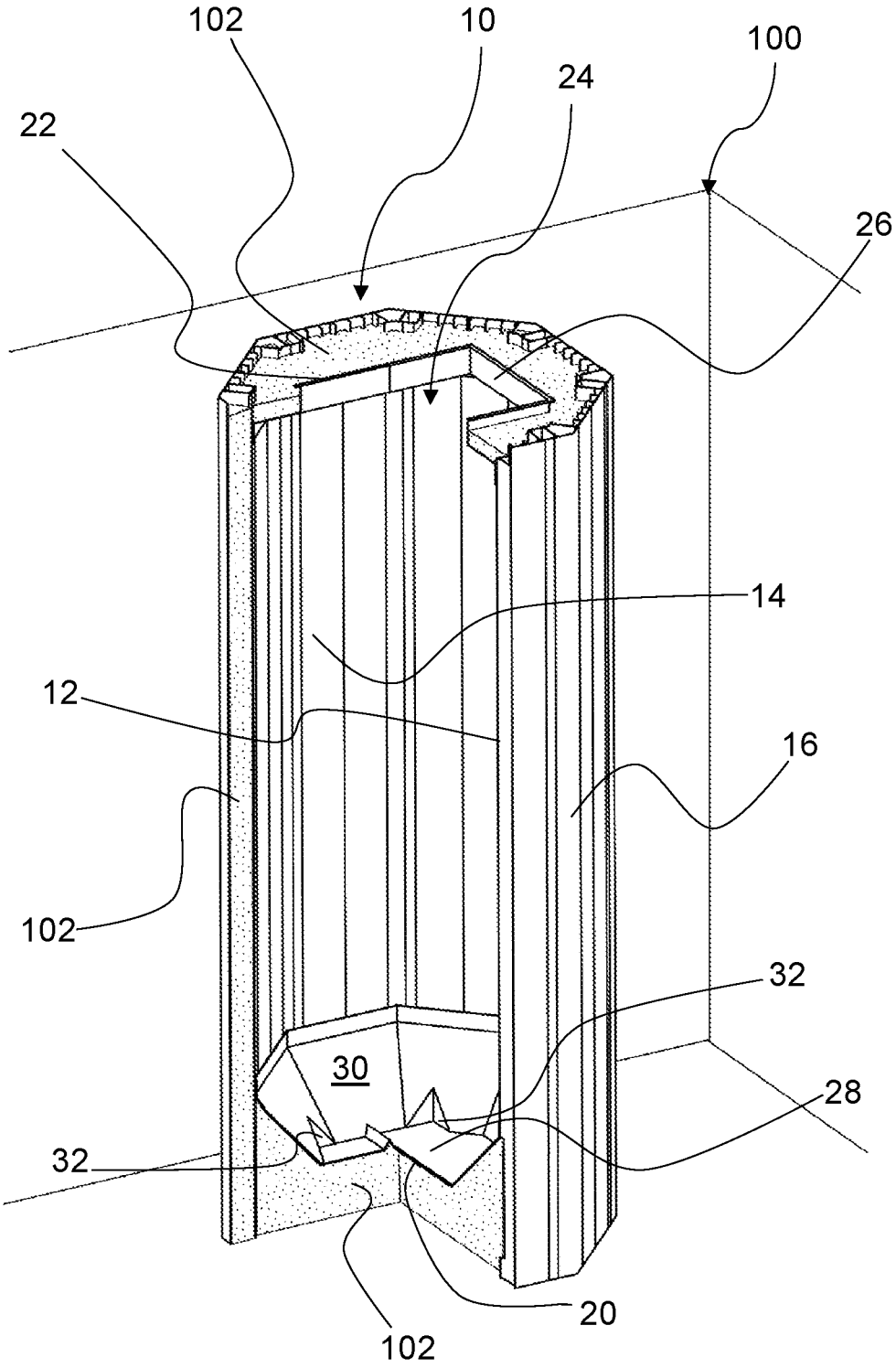
FIG. 4 shows a partial cross-sectional schematic perspective view of the prefabricated former of FIG. 1.

FIG. 4 shows the former 10 disposed within a hole 100 of the ground, prior to re-filling with either excavated material or gravel. Concrete 102 has been introduced to the former 10 as discussed above. The concrete 102 is disposed in the space below the floor former 20 and in the cavity formed between the inner layer 14 and an outer layer 16 the side wall 12. In some embodiments, concrete 102 is disposed between the wall of the rim 26 and the outer layer 16 of the side wall 12.

The mid plate 38 includes an opening 40 for allowing operatives to pass through the mid plate 38. The opening 40 is closable by means of a hatch 42.

Although not illustrated here, the former 10 is provided with water pumping apparatus pre-installed to minimise on-site work.

A method of constructing a subterranean pumping chamber using the prefabricated former 10 will now be described.

The prefabricated former 10 is assembled off-site and transported to the installation site, typically by lorry. At the installation site, a hole is excavated in the ground, typically to a depth equal to the height of the former 10. The hole may be finished with gravel or sand bulk. The former 10 is placed in the hole, standing on the bottom ends of the vertical support elements 34. Concrete is introduced into the open upper end of the cavity of the side wall 12. The concrete flows down the cavity and enters the space below the floor former 20. While the concrete flows, the former 10 may be mechanically agitated to further liquefy the concrete and ease flow. Concrete pouring may be conducted in stages, allowing the concrete to at least partially set between each stage.

The excavation is re-filled around the former 10, either with excavated material or gravel or sand bulk. Re-filling may take place during, before or after pouring of the concrete. Re-filling may take place in stages, corresponding to the staged concrete pouring.

The use of the former provides reduced site preparation time, the use of less concrete and a highly predictable amount of concrete for a given size of chamber, a quicker installation time, a stronger integral structure and reduced risk of buoyancy problems arising, compared with current methods of construction of subterranean pumping chambers.

These embodiments are provided by way of example only, and various changes and modifications will be apparent to persons skilled in the art without departing from the scope of the present invention as defined by the appended claims.

The invention claimed is:

1. A prefabricated former for an underground pumping station comprising:

a floor former;

a plurality of vertical support elements, wherein each vertical support element is joined to the floor former around a periphery of the floor former;

a side wall secured to and surrounding the plurality of vertical support elements, the side wall having an inner layer and an outer layer defining a cavity therebetween, the inner layer and outer layer extending below the floor former, wherein the inner layer extends less far than the outer layer towards a bottom end of the side wall, and an opening at an upper end of the side wall in communication with the cavity for receiving concrete, the side wall extending both above and below the floor former for defining a space above the floor former and a space below the floor former, and an opening being provided between the cavity and the space below the floor former enabling concrete to flow through the cavity and into the space below the floor former;

when set, the concrete forming a unitary wall and base.

2. A prefabricated former as claimed in claim 1, in which the side wall has an octagonal cross-section, and wherein the floor former includes a flange with an octagonal cross-section for lying against the side wall.

3. A prefabricated former as claimed in claim 1, in which the side wall is made of a plastics material.

4. A prefabricated former as claimed in claim 1, in which the floor former is fluid-tight and/or the portion of the side wall above the floor former is fluid-tight.

5. A prefabricated former as claimed in claim 1, in which the floor former is substantially concave.

6. A prefabricated former as claimed in claim 1, in which the floor former includes a central planar portion and an outer angled portion which is angled with respect to the central planar portion, wherein the outer angled portion extends from the central planar portion to the side wall.

7. A prefabricated former as claimed in claim 1, in which the floor former is formed of glass reinforced plastic or steel.

8. A prefabricated former as claimed in claim 1, further comprising a roof attached to an upper end of each of the plurality of vertical support elements.

9. A prefabricated former as claimed in claim 8, in which the roof, the portion of the side wall above the floor former and the floor former collectively define a fluid-tight chamber.

10. A prefabricated former as claimed in claim 8, in which the roof includes an access opening disposed vertically above the space above the floor former, the access opening being sized for allowing access for repair or maintenance by an operative.

11. A prefabricated former as claimed in claim 10, in which the access opening is surrounded by a vertical rim joined to the roof, the vertical rim protruding from an upper surface of the roof and being joined to an edge of the access opening.

12. A prefabricated former as claimed in claim 8, in which the inner layer of the side wall abuts an edge of the roof and the outer layer of the side wall extends past and above the roof.

13. A prefabricated former as claimed in claim 1, in which the side wall includes a utility conduit opening for receiving a utility conduit.

14. A prefabricated former as claimed in claim 1, further comprising a mid plate attached at its periphery to the plurality of vertical support elements and spaced from the floor former, wherein the mid plate includes an opening for allowing an operative to pass through the mid plate.

15. A method of constructing a subterranean pumping chamber, comprising excavating a hole in the ground or utilising an existing hole, placing a prefabricated former as claimed in claim 1 in the hole below ground level;

introducing concrete into the cavity of the side wall so that the concrete flows down the cavity and into the space below the floor former.

16. A method as claimed in claim 15, further comprising the step of mechanically agitating the concrete before the concrete has set.

17. A method as claimed in claim 15, further comprising the step of introducing material around the prefabricated former to bury the prefabricated former.

18. A method as claimed in claim 15, in which the prefabricated former includes a roof attached to an upper end of the plurality of support elements, and the concrete extends over the roof of the prefabricated former.

19. A prefabricated former for an underground pumping station comprising:

a floor former;

a plurality of vertical support elements, wherein each of the plurality vertical support elements extends both above and below the floor former; and a side wall secured to and surrounding the plurality of vertical support elements, the side wall having an inner layer and an outer layer defining a cavity therebetween, and an opening at an upper end of the side wall in communication with the cavity for receiving concrete, the side wall extending both above and below the floor former for defining a space above the floor former and a space below the floor former, and an opening being provided between the cavity and the space below the floor former enabling concrete to flow through the cavity and into the space below the floor former;

when set, the concrete forming a unitary wall and base.

* * * * *